US011506198B2

(12) United States Patent
Rolland et al.

(10) Patent No.: US 11,506,198 B2
(45) Date of Patent: Nov. 22, 2022

(54) PUMP WITH MULTIPLE OUTLETS

(71) Applicant: Thomas Magnete GmbH, Herdorf (DE)

(72) Inventors: Thomas Rolland, Gebhardshain (DE); Olaf Ohligschläger, Grünebach (DE); Bernd Köhler, Herdorf (DE); Edwin Kreuzberg, Daaden (DE); Tabea Krah, Malberg (DE); Mike Heck, Derschen (DE)

(73) Assignee: Thomas Magnete GmbH, Herdorf (DE)

( * ) Notice: Subject to any disclaimer, the term of this patent is extended or adjusted under 35 U.S.C. 154(b) by 11 days.

(21) Appl. No.: 16/800,232

(22) Filed: Feb. 25, 2020

(65) Prior Publication Data

US 2020/0300238 A1 Sep. 24, 2020

(30) Foreign Application Priority Data

Feb. 25, 2019 (DE) ..... 10 2019 104 648.3

(51) Int. Cl.
*F04B 53/10* (2006.01)
*F04B 17/04* (2006.01)
(Continued)

(52) U.S. Cl.
CPC ..... *F04B 53/10* (2013.01); *F04B 1/005* (2013.01); *F04B 1/03* (2020.01); *F04B 13/00* (2013.01);
(Continued)

(58) Field of Classification Search
CPC ..... F04B 53/10; F04B 13/00; F04B 17/04; F04B 53/1002; F04B 53/143; F04B 23/02; F04B 17/044; F04B 15/02; F16K 11/05; F16K 11/0655; F16K 11/07; Y10T 137/87772
See application file for complete search history.

(56) References Cited

U.S. PATENT DOCUMENTS 5,275,539 A * 1/1994 Custer, Jr. ..... F01M 1/16 123/452
2004/0234380 A1* 11/2004 Moutafis ..... F04B 53/147 417/53
(Continued)

FOREIGN PATENT DOCUMENTS

DE 10020896 A1 10/2001
DE 10033923 A1 1/2002
(Continued)

OTHER PUBLICATIONS

EP0449692 translation (Year: 2021).*
(Continued)

*Primary Examiner* — Kenneth J Hansen
*Assistant Examiner* — David N Brandt
(74) *Attorney, Agent, or Firm* — Harness, Dickey & Pierce, P.L.C.

(57) ABSTRACT

A multiflow pump for fluids, having an electromagnetic translator drive, a displacement piston unit, a pump head, and at least one outlet valve device. The displacement piston contains a bearing journal with a spring receptacle, a carrier plate, and a plurality of pump pistons, wherein the displacement piston unit is configured in one piece.

9 Claims, 3 Drawing Sheets

(51) Int. Cl.

| | |
|---|---|
| ***F04B 1/03*** | (2020.01) |
| ***F04B 1/00*** | (2020.01) |
| ***F04B 53/14*** | (2006.01) |
| ***F04B 13/00*** | (2006.01) |
| *F04B 1/14* | (2020.01) |

(52) U.S. Cl.
CPC ..... *F04B 17/04* (2013.01); *F04B 1/14* (2013.01); *F04B 53/143* (2013.01)

(56) References Cited

U.S. PATENT DOCUMENTS

| | | | | |
|---|---|---|---|---|
| 2005/0169786 | A1* | 8/2005 | Masushige | F04B 17/042 417/557 |
| 2013/0156613 | A1* | 6/2013 | Reuter | B60T 8/4031 417/313 |
| 2017/0096987 | A1* | 4/2017 | Asayama | F04B 1/02 |

FOREIGN PATENT DOCUMENTS

| | | | | |
|---|---|---|---|---|
| DE | 102011088699 | A1 | 6/2013 | |
| EP | 0449692 | A1 * | 10/1991 | F16N 13/22 |

OTHER PUBLICATIONS

German Office Action regarding German Patent Application No. 102014012307.3, dated Nov. 10, 2014.
European Office Action regarding European Application No. 15759632.1, dated Nov. 5, 2020.

* cited by examiner

PUMP WITH MULTIPLE OUTLETS

CROSS-REFERENCE TO RELATED APPLICATIONS

This application claims the benefit and priority of German Application No. DE 10 2019 104 648.3 filed on Feb. 25, 2019. The entire disclosure of the above application is incorporated herein by reference.

FIELD

The present disclosure relates to a multiflow pump for fluids which can include an electromagnetic translatory drive, a displacement piston unit, a pump head and at least one outlet valve device.

BACKGROUND

This section provides background information related to the present disclosure which is not necessarily prior art.

Multiflow pumps are known and are used for fuel injection and for lubricant supply. It is usually the case that considerably more cost-effective multiflow pumps are used for lubricant supply than for fuel injection; however, the former have a considerably lower metering accuracy and are generally not diagnosable.

It is an object to further develop a multiflow pump for lubricant supply while maintaining the low costs in the direction of better metering accuracy and higher reliability.

SUMMARY

This section provides a general summary of the disclosure, and is not a comprehensive disclosure of its full scope or all of its features.

An embodiment can include the technical teaching that the displacement piston unit contains a bearing journal with a spring receptacle, a carrier plate and a plurality of pump pistons, wherein the displacement piston unit is configured in one piece.

The configuration of the displacement piston unit can considerably simplify the accurate setting of the metering quantities, thereby achieving a higher degree of metering accuracy. The configuration of the carrier plate can allow a stroke setting in the electromagnetic drive and a long stroke of the displacement piston unit.

The configuration can include an engine-lubricating system having a multiflow pump according to the invention.

The pump head contains a plurality of cylinder bores into which the pump pistons can plunge, wherein the cylinder bores accommodate the outlet valve devices on the side facing away from the pump pistons.

This is a cost-optimal configuration, in particular in conjunction with a configuration of the pump head from plastic.

The pump head advantageously has a common suction line connection which is fluidically connected to all pump pistons on the suction side, and a filter chamber which can accommodate a filter element is arranged in the vicinity of the suction line connection.

The outlet valve devices can each consist of a sleeve, a spring, a sealing body and a valve seat.

This is a tried and tested and reliable configuration which is also cost-effective because the sleeve also provides a hose connection.

In another configuration, the sleeve is configured to be longer and also contains the cylindrical running surface for the pump piston.

The pump head is advantageously produced from a plastics material by injection-moulding, wherein the sleeves of the outlet valve devices are connected to the pump head by injection. For this purpose, the sleeves are inserted into the injection mould as insert parts prior to the injection-moulding operation.

This injection of the sleeves further reduces the production costs, in particular the assembly costs, saves on further seals and, by comparison with pressing-in, reduces the stresses in the material of the pump head. This configuration also allows a very compact design of the pump head because threads, holders or additional seals are avoided.

The translatory drive can be configured as an electromagnet which contains a magnet coil, a magnet pole, an iron circuit and a magnet armature, wherein the magnet armature is in frictional operative connection with a tappet, and wherein the position of the tappet in the magnet armature can be displaced during the production process of the multiflow pump.

This configuration allows magnet-side setting of the delivery stroke for all pump devices, resulting in a high degree of accuracy and low costs.

The iron circuit of the electromagnet is advantageously provided with a plastic encapsulation which is connected to the pump head in a frictional, form-fitting or integrally bonded manner. Here, a form-fit is chosen for radial guidance and, for axial fixing, a force-fit or an integral bond by welding.

The pump pistons are provided with elastomer seals which bear against axial surfaces of the pump pistons during the working stroke of the displacement piston unit, wherein sealing of the pump pistons with respect to the cylinder bores is achieved, and the elastomer seals lift off the axial surfaces of the pump pistons during the return stroke of the displacement piston unit, with there then being a fluidic connection from a working chamber of the displacement piston unit to the cylinder bore. The configuration of the elastomer seals and of the pump pistons saves on the use of additional suction valves.

The pump head has a suction line connection which is fluidically connected to the working chamber of the displacement piston unit, and a filter chamber which can accommodate a filter element is arranged in the vicinity of the suction line connection.

The multiflow pump is advantageously a constituent part of an engine-lubricating system which also contains an internal combustion engine, a lubricant supply reservoir and an electric controller.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
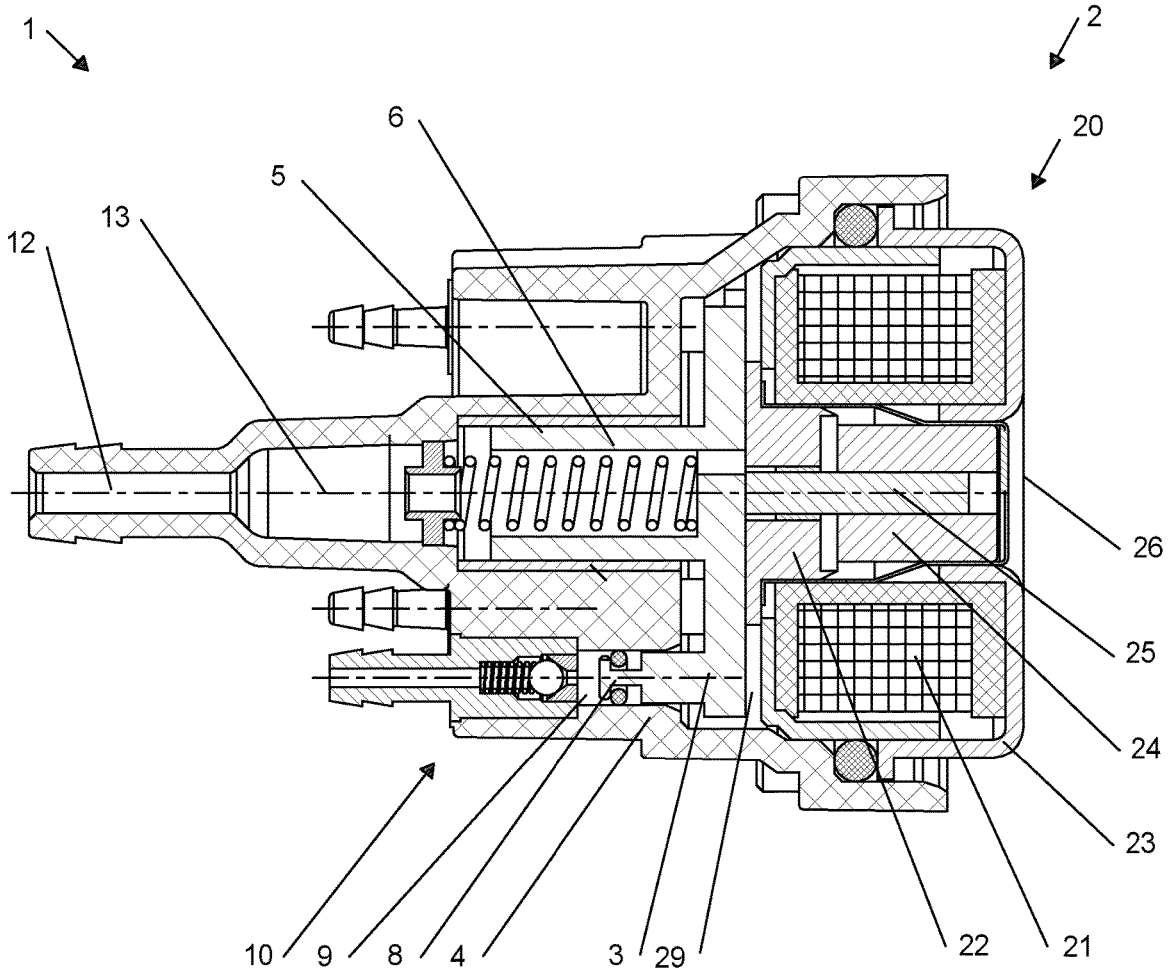
FIG. 1 shows a cross section of the multiflow pump.
Figure 2:
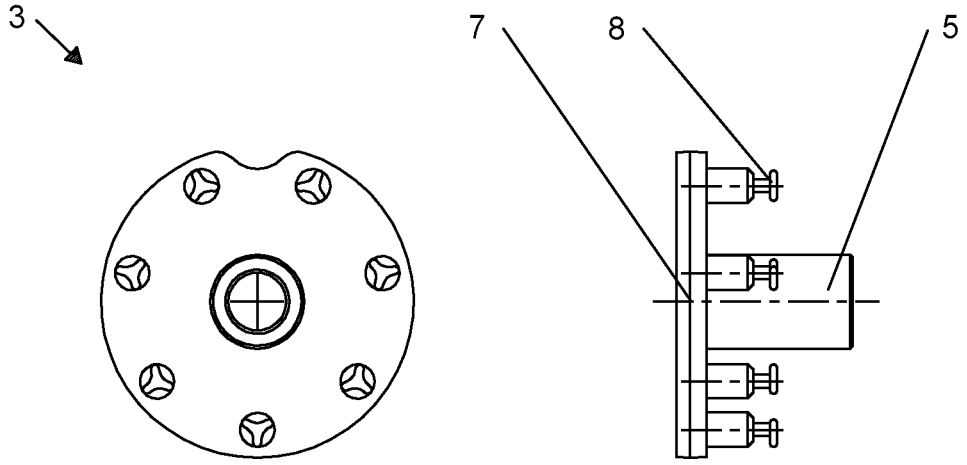
FIG. 2 shows a view of the displacement piston unit.

FIG. 1 and FIG. 2 show a multiflow pump 1 according to the invention for fluids, which has an electromagnetic translatory drive 2, a displacement piston unit 3, a pump head 4, and a plurality of outlet valve devices 10. The displacement piston unit 3 contains a bearing journal 5 with a spring receptacle 6, a carrier plate 7, and a plurality of pump pistons 8, wherein the displacement piston 3 is configured in one piece.

The pump head 4 contains a plurality of cylinder bores 9 into which the pump pistons 8 plunge, wherein the cylinder bores 9 accommodate the outlet valve devices 10 on the side facing away from the pump pistons 8.

The pump head 4 has a suction line connection 12 which is fluidically connected to all pump pistons 8 on the suction side, and, in the vicinity of the suction line connection 12, the pump head has a filter chamber 13 which can accommodate a filter element not shown.

Figure 3:
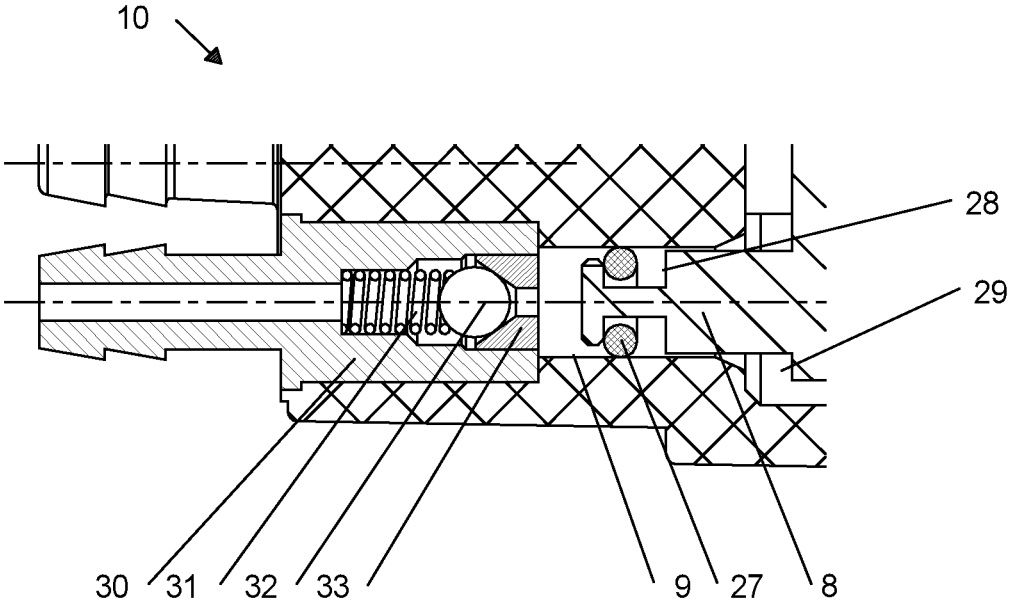
FIG. 3 shows a detail section of a pump piston, a cylinder bore, and an outlet valve device.

FIG. 3 shows an outlet valve device 10 which in each case consists of a sleeve 30, a spring 31, a sealing body 32, and a valve seat 33.

The pump head 4 is produced from a plastics material by injection-moulding, wherein the sleeves 30 of the outlet valve devices 10 are connected to the pump head 4 by injection.

The translatory drive 2 is, as shown in FIG. 1, configured as an electromagnet 20 which contains a magnet coil 21, a magnet pole 22, an iron circuit 23, and a magnet armature 24, wherein the magnet armature 24 is in frictional operative connection with a tappet 25, and wherein the position of the tappet 25 in the magnet armature can be displaced during the production process of the multiflow pump 1.

In an advantageous configuration, the iron circuit 23 of the electromagnet 20 is provided with a plastic encapsulation 26, which is connected to the pump head 4 in a form-fitting, frictional or integrally bonded manner.

FIG. 3 shows that the pump pistons 8 are provided with elastomer seals 27 which can bear against axial surfaces 28 of the pump pistons 8 during the working stroke of the displacement piston unit 3, and can lift off the axial surfaces 28 of the pump pistons 8 during the return stroke of the displacement piston unit 3, with there then being a fluidic connection from a working chamber 29 of the displacement piston unit 3 to the cylinder bore 9.

As shown in FIG. 1, the pump head 4 has a suction line connection 12 which is fluidically connected to the working chamber 29 on the suction side, and a filter chamber 13, which can accommodate a filter element is arranged in the vicinity of the suction line connection 12.

Figure 4:
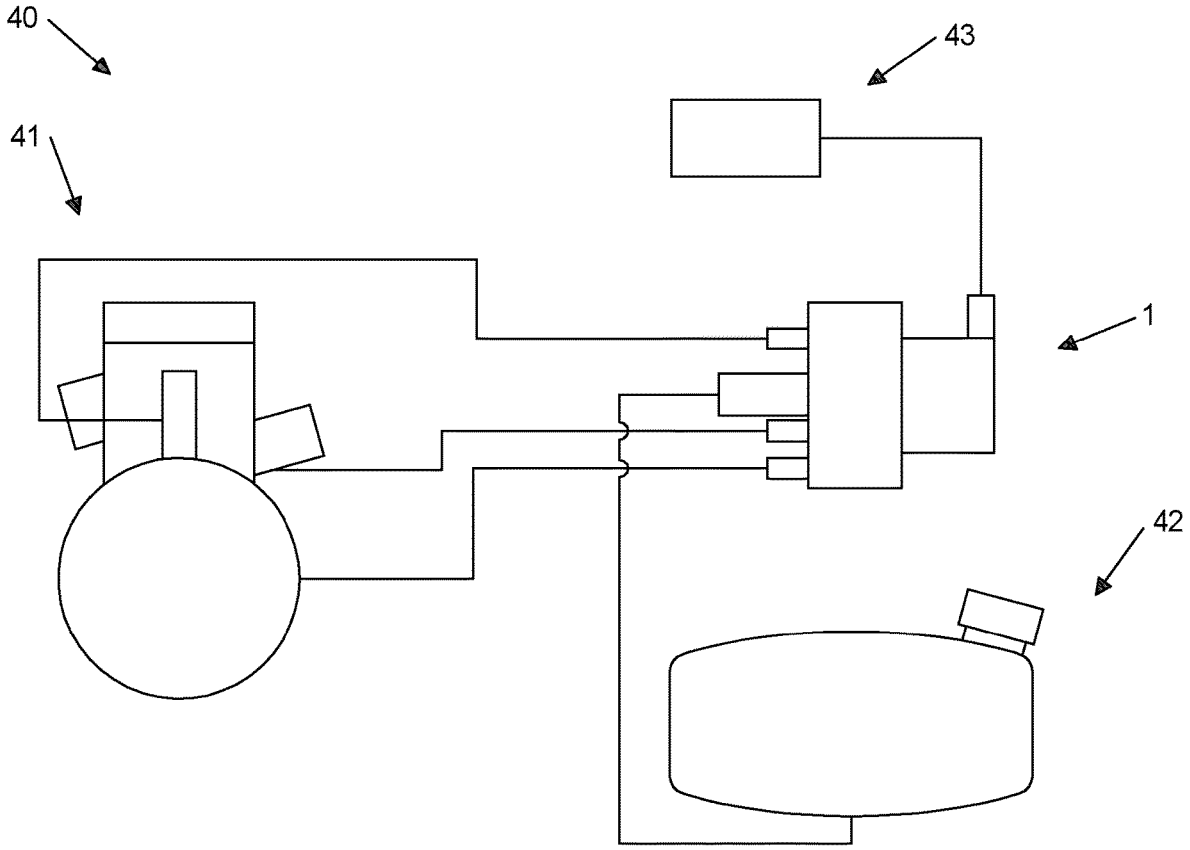
FIG. 4 shows a system for supplying lubricant to an internal combustion engine having a multiflow pump according to the present embodiment.

FIG. 4 shows an engine-lubricating system 40 having an internal combustion engine 41, a lubricant supply reservoir 42, an electric controller 43, and a multiflow pump 1, according to the invention.

LIST OF REFERENCE SIGNS

1 Multiflow pump
2 Drive
3 Displacement piston unit
4 Pump head
5 Bearing journal
6 Spring receptacle
7 Carrier plate
8 Pump piston
9 Cylinder bore
10 Outlet valve device
11 Valve element
12 Suction line connection
13 Filter chamber
20 Electromagnet
21 Magnet coil
22 Magnet pole
23 Iron circuit
24 Magnet armature
25 Tappet
26 Plastic encapsulation
27 Elastomer seal
28 Axial surface
29 Working chamber
30 Sleeve
31 Spring
32 Sealing body
33 Valve seat
40 Engine-lubricating system
41 Internal combustion engine
42 Lubricant reservoir
43 Electric controller The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiflow pump for fluids, comprising:
an electromagnetic translatory drive;
a displacement piston unit;
a pump head; and
at least one outlet valve device;
wherein the displacement piston unit contains a bearing journal with a spring receptacle, a carrier plate, and a plurality of pump pistons;
wherein the displacement piston unit is configured in one piece; and
wherein each pump piston of the plurality of pump pistons is provided with an elastomer seal which bears against an axial surface of each respective pump piston during a working stroke of the displacement piston unit, and in that each elastomer seal lifts off the respective axial surface of each respective pump piston during a return stroke of the displacement piston unit.

2. The multiflow pump of claim 1, wherein the pump head contains a plurality of cylinder bores, each pump piston of the plurality of pump pistons at least partially plunges into a respective cylinder bore of the plurality of cylinder bores, each cylinder bore of the plurality of cylinder bores receives an outlet valve device of the at least one outlet valve device on one side of each cylinder bore facing away from the pump pistons.

3. The multiflow pump of claim 2, wherein each outlet valve device includes a sleeve, a spring, a sealing body, and a valve seat.

4. The multiflow pump of claim 3, wherein the pump head is produced from a plastics material by injection-moulding, wherein each sleeve of each outlet valve device is encapsulated with the plastics material.

5. The multiflow pump of claim 1, wherein the translatory drive is configured as an electromagnet which contains a magnet coil, a magnet pole, an iron circuit, and a magnet armature, wherein the magnet armature is in frictional operative connection with a tappet.

6. The multiflow pump of claim 5, wherein the iron circuit of the electromagnet is provided with a plastic encapsulation which is connected to the pump head in a form-fitting or frictional or integrally bonded manner.

7. The multiflow pump of claim 1, wherein the pump head has a suction line connection which is fluidically connected to the working chamber.

8. The multiflow pump of claim 7, wherein the pump head has, in the vicinity of the suction line connection, a filter chamber in which a filter element can be accommodated.

9. An engine-lubricating system, comprising:

an internal combustion engine;

a lubricant supply reservoir;

an electric controller; and a multiflow pump;

wherein the multiflow pump has an electromagnetic translatory drive, a displacement piston unit, a pump head, and at least one outlet valve device;

wherein the displacement piston unit contains a bearing journal with a spring receptacle, a carrier plate and a plurality of pump pistons;

wherein the displacement piston unit is configured in one piece; and wherein each pump piston of the plurality of pump pistons is provided with an elastomer seal which bears against an axial surface of each respective pump piston during a working stroke of the displacement piston unit, and in that each elastomer seal lifts off the respective axial surface of each respective pump piston during a return stroke of the displacement piston unit.

* * * * *